US011623848B2

(12) United States Patent
Tranchero

(10) Patent No.: US 11,623,848 B2
(45) Date of Patent: Apr. 11, 2023

(54) CRANE WITH ANTI-TIPPING CONTROL SYSTEM

(71) Applicant: Jacques Tranchero, Costigliole Saluzzo (IT)

(72) Inventor: Jacques Tranchero, Costigliole Saluzzo (IT)

( * ) Notice: Subject to any disclaimer, the term of this patent is extended or adjusted under 35 U.S.C. 154(b) by 798 days.

(21) Appl. No.: 16/603,133

(22) PCT Filed: Mar. 30, 2018

(86) PCT No.: PCT/IB2018/052230
§ 371 (c)(1),
(2) Date: Oct. 4, 2019

(87) PCT Pub. No.: WO2018/185632
PCT Pub. Date: Oct. 11, 2018

(65) Prior Publication Data

US 2020/0290848 A1 Sep. 17, 2020

(30) Foreign Application Priority Data

Apr. 5, 2017 (IT) ..... 102017000037143

(51) Int. Cl.
*B66C 23/00* (2006.01)
*B66C 23/90* (2006.01)
(Continued)

(52) U.S. Cl.
CPC ..... *B66C 23/905* (2013.01); *B66C 23/42* (2013.01); *B66C 23/78* (2013.01); *B66C 23/94* (2013.01);
(Continued)

(58) Field of Classification Search
CPC ..... B66C 23/905; B66C 23/42; B66C 23/78; B66C 23/94; B66C 2700/0371; B66C 2700/084
See application file for complete search history.

(56) References Cited

U.S. PATENT DOCUMENTS 5,887,735 A 3/1999 Abel
7,370,723 B2 * 5/2008 Bitter ..... E02F 9/24 180/338
(Continued)

FOREIGN PATENT DOCUMENTS

CA 2997589 A1 * 8/2019 ..... B66C 13/16
DE 2355523 A1 5/1975
(Continued)

OTHER PUBLICATIONS

International Preliminary Report on Patentability from International Application No. PCT/IB2018/052230, dated Mar. 14, 2019.
International Search Report and Written Opinion from International Application No. PCT/IB2018/052230, dated Jul. 11, 2018.

*Primary Examiner* — Emmanuel M Marcelo
(74) *Attorney, Agent, or Firm* — Merchant & Gould P.C.

(57) ABSTRACT

A crane for lifting and transporting loads includes a base frame to transfer loads onto a support surface by a plurality of contacts in contact with the surface. An arm for lifting loads is rotatable relative to the base frame around a vertical axis. The angular range of the arm around the vertical axis includes angular fields, and load sensors. Each load sensor is associated with a respective contact to detect the force on the support surface. A control system obtains, from the load sensors, the value of the force, and detects the angular field where the arm is located. The control system determines a danger condition based on the values detected by the load sensors, according to different criteria in at least two different angular fields. The control system carries out predeter-
(Continued)

mined functions of the crane, if the danger condition is reached.

12 Claims, 2 Drawing Sheets

(51) Int. Cl.
*B66C 23/42* (2006.01)
*B66C 23/78* (2006.01)
*B66C 23/94* (2006.01)

(52) U.S. Cl.
CPC ..... *B66C 23/54* (2013.01); *B66C 2700/0371* (2013.01)

(56) References Cited

U.S. PATENT DOCUMENTS

| | | | | |
|---|---|---|---|---|
| 2004/0200644 | A1* | 10/2004 | Paine | G01G 19/083 177/136 |
| 2007/0012641 | A1 | 1/2007 | Hinata | |
| 2014/0032060 | A1 | 1/2014 | Zinke | |
| 2019/0031474 | A1* | 1/2019 | Stilborn | B66C 13/16 |

FOREIGN PATENT DOCUMENTS

| | | | |
|---|---|---|---|
| EP | 0779237 | A2 | 6/1997 |
| EP | 2298689 | A2 | 3/2011 |
| JP | 3189862 | B2 * | 7/2001 |
| RU | 2267458 | C1 * | 1/2006 |
| RU | 2271986 | C2 * | 3/2006 |

* cited by examiner

CRANE WITH ANTI-TIPPING CONTROL SYSTEM

This application is a National Stage Application of International Application No. PCT/IB2018/052230, filed Mar. 30, 2018, which claims benefit of Ser. No. 10/2017/000037143, filed 5 Apr. 2017 in Italy and which applications are incorporated herein by reference. To the extent appropriate, a claim of priority is made to each of the above disclosed applications.

TECHNICAL FIELD

The invention relates to a crane, or equipment, for lifting and moving loads, which is provided with a roll-over protection system.

TECHNOLOGICAL BACKGROUND

In the industrial field, as well as in the craft industry, the need to pick up, move and position loads, even considerably heavy ones, to/at substantial heights and distances from the pick-up point is well known.

However, due to the considerable weight of the load to be moved, as well as the distance between said load and the crane, the crane is in danger of rolling over, consequently posing risks to the people in its vicinity and to the goods. Furthermore, during the moving of loads, there is a high risk of dynamic roll-over due to the abrupt movements of certain parts of the crane itself.

Generally speaking, the crane has a rectangular support base resting on the ground and an arm capable of rotating around a vertical axis and bearing the loads to be moved. When the arm rotates around the vertical axis, the "effective" length of the support foot varies depending on the angular position of the arm relative to the support base. Namely, based on the angular position of the arm, the plan projection of the arm intercepts a support foot with a different length, thus determining a different lever arm opposing the roll-over of the crane. Therefore, there is a different degree of safety depending on the position of the arm around a vertical axis relative to the rest of the crane. Indeed, if the plan projection of the arm intercepts a longer support foot, there is a greater degree of safety, and vice versa.

A drawback of known cranes lies in the fact that they are not capable of taking into account this situation, thus ensuring an efficient roll-over protection system.

SUMMARY OF THE INVENTION

An object of the invention is to provide a crane for lifting and moving loads, equipped with a roll-over protection system, which is able to solve this and other drawbacks of the prior art and which, at the same time, can be produced in a simple and economic fashion.

In particular, one of the technical problems solved by the invention is that of providing a crane for lifting and moving loads, equipped with an roll-over protection system, which is able to operate in a prompt, precise and safe manner, taking into account the position of the arm relative to the remaining structure of the crane.

According to the invention, this and other objects are reached by a crane.

The appended claims are an integral part of the technical teaches provided in the following detailed description concerning the invention. In particular, the appended dependent claims define some preferred embodiments of the invention and describe optional technical features.

BRIEF DESCRIPTION OF THE DRAWINGS

Further features and advantages of the invention will be best understood upon perusal of the following detailed description, which is provided by way of example and is not limiting, with reference, in particular, to the accompanying drawings, wherein.

DETAILED DESCRIPTION OF THE INVENTION

Figure 1:
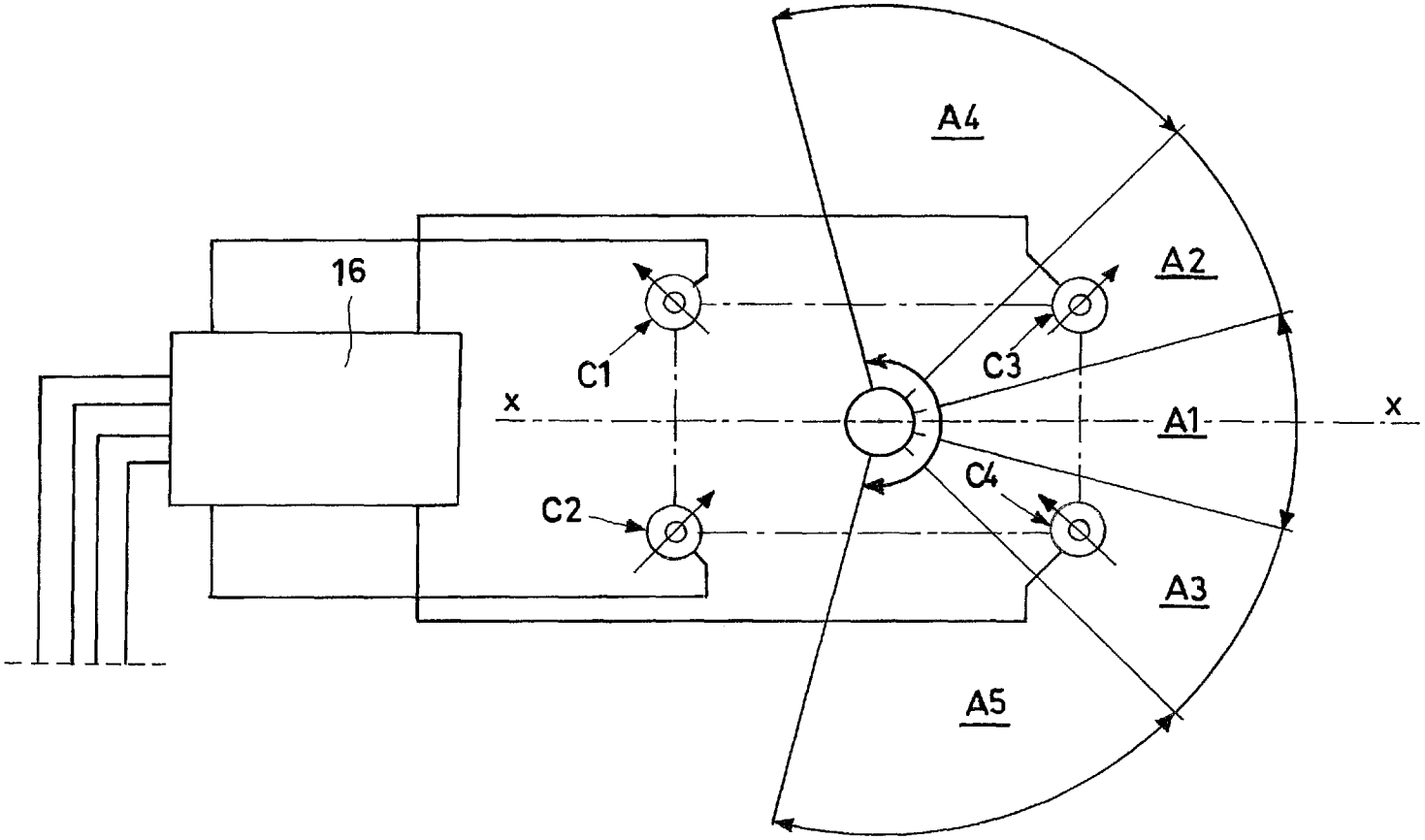
FIG. 1 is plan view of a diagram referring to the roll-over protection system according to an embodiment of the invention.
Figure 2:
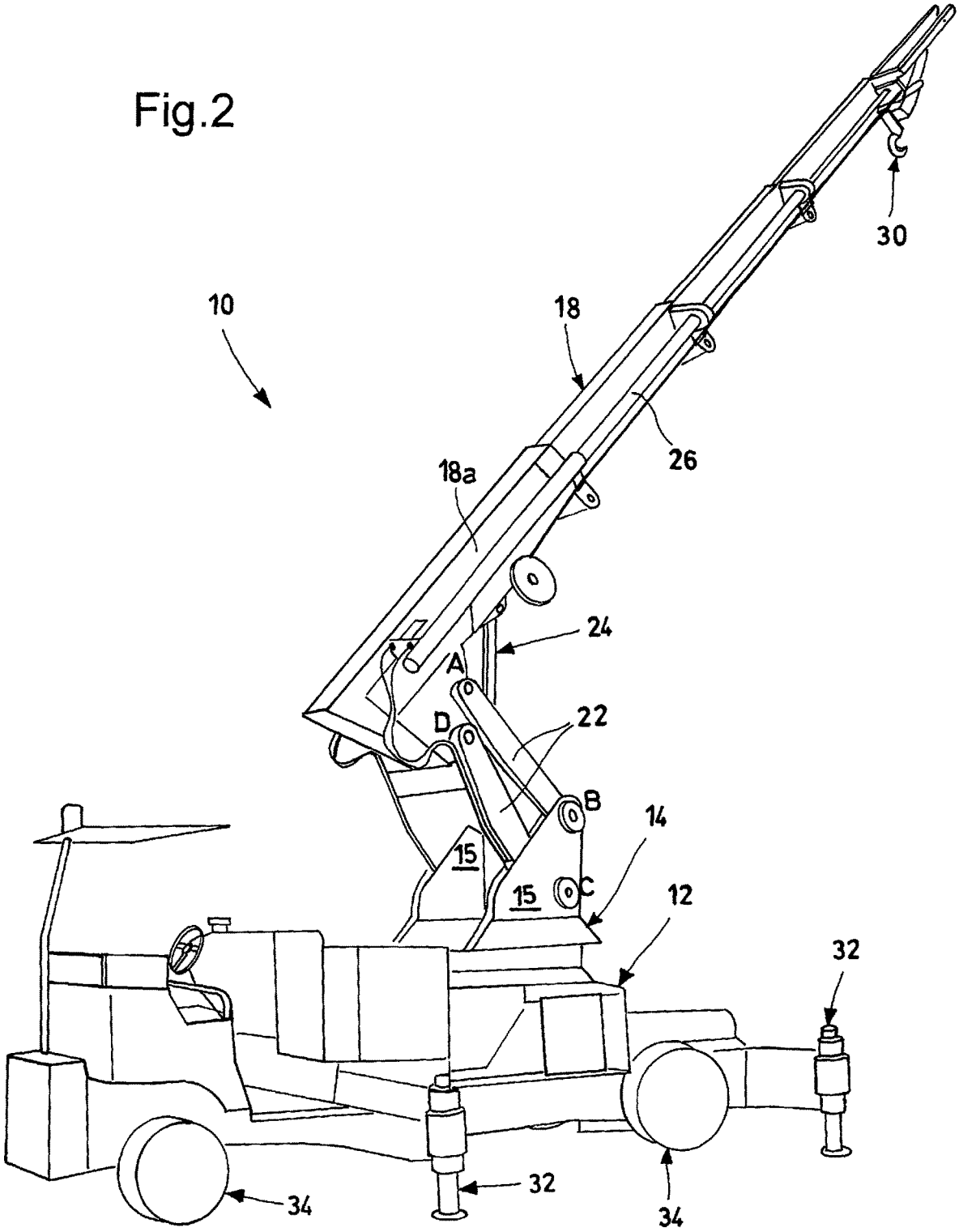
FIG. 2 is a perspective view of a crane according to a particular variant of the invention.

With reference to the accompanying figures, number 10 indicates, as a whole, a crane for lifting and moving loads, comprising:

a base frame 12, for transferring the loads of crane 10 onto a support surface by means of a plurality of contact means in contact with said surface;

an arm 18 for lifting and transporting loads, which is capable of rotating relative to said base frame 12 around a vertical axis, wherein the angular range of said arm around the vertical axis comprises a plurality of angular fields A1, A2, A3, A4, A5;

a plurality of load sensors C1, C2, C3, C4, each load sensor being associated with a respective contact means and adapted to detect the force exchanged by the respective contact means with the support surface;

a control system 16, which is designed to obtain, from said load sensors the value of the force acting upon the respective contact means, detect the angular field where said arm 18 is located, determine a danger condition based on the values detected by at least one of said load sensors, wherein said danger condition is determined according to different criteria in at least two different angular fields, carry out predetermined functions of crane 10, if said danger condition is reached.

In other words, two different criteria are used to determine the danger condition in at least two different angular fields.

Preferably, arm 18 is also—though not exclusively—capable of moving around a substantially vertical axis. Furthermore, the arm can be of a known type, for example it can be telescopic or consist of different segments articulated to one another, etc.; preferably, an angular encoder is provided so as to detect the angular field where the arm is located. The angular encoder conveniently is located between arm 18 and the rest of the crane.

Preferably, angular fields A1, A2, A3, A4, A5 are arranged symmetrically relative to a vertical plane including a longitudinal movement axis x-x of crane 10. In particular, the angular fields comprise: a central angular field A1, where the vertical plane including the longitudinal movement axis x-x passes, and a plurality of lateral angular fields. With reference to the example shown herein, there are five angular fields, two angular fields A2, A4 being arranged on the left relative to central angular field A1, and two angular fields A3, A5 being arranged on the right relative to the central angular field A1. The angular fields A2, A3, A4, A5 are arranged symmetrically relative to angular field A1. By way of example, the angular fields have the following angular width: A1, A2, A3 equal to 30°; A4 and A5 equal to 45°. The total angular range of the arm, in this case, amounts to 180°.

According to a variant of the invention, the vertical plane including the longitudinal movement axis x-x is astride two angular fields.

Preferably, the danger condition is determined with a mathematical formula, whose variables include the values detected by at least one of said load sensors C1, C2, C3, C4, wherein said control system uses two different formulas in at least two different angular fields A1, A2, A3, A4, A5. Therefore, for example, a first formula is used in the central angular field A1 and a second formula (different from the first formula) is used in the second angular field A2. Conveniently, the control system is configured to use a different formula for each angular field A1, A2, A3, A4, A5.

Preferably, said formula takes into account a different number of load sensors C1, C2, C3, C4 in at least two different angular fields A1, A2, A3, A4, A5. For example, in the central angular field A1 a first formula is used, whose variables comprise the values detected by a first number of load sensors, and in the second angular field A2 a second formula is used, whose variables comprise the values detected by a second number of load sensors.

With reference to a particular embodiment and to FIG. 1, the formulas in the different angular fields A1, A2, A3, A4, A5 are the followings:

| angular field | formula |
|---|---|
| A1 | C1 + C2 |
| A2 | C1 + C2 + C4 |
| A3 | C1 + C2 + C3 |
| A4 | C2 + C4 |
| A5 | C1 + C3 |

Therefore, for angular field A1, the formula is the sum of the values detected by the load sensors C1 and C2. In general, in each angular field A1-A5, the formula is a sum of the values detected by (at least) some load sensors C1-C4. In other words, the formula preferably is a summation. Hence, the result of the formula is the value of a force or of a mass.

As you can assume from the table above, when arm 18 is in the central angular field A1, the formula used is a sum of the values detected by a first and a second load sensors C1, C2;

when arm 18 is in the second angular field A2, the formula used is a sum of the values detected by the first, the second and a fourth load sensors C1, C2, C4;

when arm 18 is in the third angular field A3, the formula used is a sum of the values detected by the first, the second and a third load sensors C1, C2, C3;

when arm 18 is in the fourth angular field A4, the formula used is a sum of the values detected by the second and the fourth load sensors C2, C4;

when arm 18 is in the fifth angular field A5, the formula used is a sum of the values detected by the first and the third load sensors C1, C3.

In particular, with reference to the figures, when arm 18 is in angular fields A1, A4, A5, the system takes into account the two load sensors arranged in a substantially opposite position relative to arm 18, namely C1 and C2, C2 and C4, C1 and C3, respectively.

Preferably, if the value of the formula exceeds or reaches a threshold value, the danger condition is reached. For example, if the sum of the values C1+C2 is below a threshold value (for example 200 Kg), the danger condition is reached. Hence, the threshold value can be a bottom or top limit to be compared with the result of the formula, so as to determine whether the danger condition is reached.

The contact means comprise movable contact means, such as wheels 34 or tracks, and/or stabilizers 32. For example, some wheels 34 are driving wheel and the other wheels are driven wheels. In the example there are four wheels 34, in particular arranged at the vertexes of a rectangle in plan view. Conveniently, one or more wheels 34 are steering wheels. Preferably, the movable contact means comprise a ground drive transmission means. The ground drive transmission means can comprise a driving wheel, or a track, or any other means for transmitting a driving force onto a support surface. Preferably, stabilizers 32 are constrained to base frame 12 and, preferably, are extractable in a known manner. In the example there are four stabilizers 32, in particular located at the vertexes of a rectangle in plan view.

Preferably, the contact means comprise movable contact means, such as wheels 34 or tracks, and stabilizers 32; said load sensors C1, C2, C3, C4 being associated with at least some motion transmission means and with at least some stabilizers 32. In particular, there are four contact means (in the example, wheels 34) and four stabilizers 32. For example each contact means can be associated with the respective load sensor. Preferably, each stabilizer 32 is associated with the respective load sensor. For the sake of simplicity, FIG. 1 shows four load sensors C1-C4, which, for example, can refer to the load sensors associated with the four stabilizers 32. Conveniently, when stabilizers 32 are in use, the control system is configured to detect the reactions of load sensors C1-C4 associated with stabilizers 32; on the other hand, when stabilizers 32 are not in use, the control system is configured to detect the reactions of loads sensors C1-C4 associated with the movable contact means. For example, the crane has four wheels 34 and four stabilizers 32 and it also has eight load sensors associated with wheels 34 and stabilizers 32.

Preferably, crane 10 has an interface, through which the user can receive information concerning the crane, for example through the control system. Furthermore, the interface can conveniently allow the user to give orders to the crane, for example through the control system. The interface can be of a known type and it can comprise a screen or touch screen, keys, buttons, etc. Optionally, through the interface, the user can change the intervention of the roll-over protection system.

For greater clarity, a non-limiting description of a crane 10 having a particular structure and a preferred lifting mechanism is provided below. With particular reference to the variant shown, crane 10 comprises:

base frame 12;

a turret 14, which is fixed to base frame 12 so as to rotate, in particular around a substantially vertical axis, arm 18, for moving loads and is mounted on turret 14 in a movable manner.

In particular, the crane includes a pair of connecting rod elements 22, each connecting rod element 22 being hinged to turret 14 and to arm 18, so as to create an articulated quadrilateral. There is a first linear actuator fitted on turret 14 and hinged to arm 18, which is capable of causing the lifting movement of arm 18.

In a non-limiting manner, FIG. 1 shows an articulated quadrilateral, which is defined by the points indicated with letters A, B, C, D.

In particular, turret 14 has a pair of brackets 15, in particular arranged vertically. A respective pair of connecting rod elements 22 pivots on each bracket 15. Therefore, there are two pairs of connecting rod elements 22, substantially arranged on the sides of arm 18.

Conveniently, arm 18 is telescopic and comprises sliding segments controlled by a second linear actuator 26. A first segment 18*a* is constrained to turret 14 in a movable manner and at least one further segment can slide relative to the first segment 18*a*. The second linear actuator 26 is adapted to perform the extraction/retraction of the segments, so as to increase/decrease the reach of arm 18. The top end of the first linear actuator 24 is hinged to the first segment 18*a*. Conveniently, linear actuators 24, 26, or at least one of them, are hydraulic jacks. Conveniently, at least one of the linear actuators 24, 26 is a hydraulic jack with two simultaneous stages. Connecting rod elements 22 are hinged to the first segment 18*a*.

Preferably, arm 18 is provided with means for attaching and transporting the loads, such as, for example, a clamp, tongs, a hook 30, or a platform, etc. For example, arm 18 is associated with a winch system or a hoist, in order to move the loads. Said winch is conveniently activated by a motor means, such as an electric motor. The winch (or hoist) is associated with a hook 30, or the like, which can be extracted or retracted by operating the winch.

The control tools can comprise, for example, push-buttons, levers, screens, warning lights, sirens, indicators of different types, thus allowing the user to receive signals of various kinds regarding the operation of crane 10.

In general, when the danger condition is reached, the control system can be suited to carry out many and different predetermined tasks, such as for example: stopping one or more linear actuators 24, 26; performing one or more predetermined movements of at least one linear actuator 24, 26; interrupting the operation of driving wheel 34; emitting an emergency signal that can be perceived by a user (e.g. light and/or sound signal), etc.

In general, the control system can be designed in such a way that, when the danger condition is reached, every movement of crane 10 that is likely to cause an increase in the rolling-over torque is interrupted or inhibited. The control system can also be designed in such a way that, when the danger condition is reached, one or more movements of crane 10 that are likely to cause a decrease in the rolling-over torque are carried out.

Furthermore, as one can clearly understand, the roll-over protection system also intervenes in order to prevent crane 10 from rolling over in dynamic operating conditions, since crane 10, in order to move the loads, moves its parts and, if necessary, moves along the support surface.

Crane 10 preferably comprises at least one electric battery, which can be of the rechargeable type or not. Conveniently, the battery is rechargeable and can be recharged without being removed from the crane through suitable battery recharging means, for example by connecting the battery recharging means to an industrial or domestic socket outlet.

The battery is adapted to supply the power required to carry out one or more of the following operations: activating the linear actuators; activating the signaling devices, among which the acoustic and visual ones; supplying power to the control system; activating the ground drive transmission means (e.g. the driving wheel); etc.

According to further variants, arm 18 of crane 10 can be moved by means of a wire rope system, alternatively or in addition to linear actuator 24, 26.

According to a variant of the invention, driving wheels 34 are provided with respective motors, preferably electric motors. The motor of each driving wheel acts independently of the other ones. Optionally, all wheels 34 are driving wheels; therefore, the crane is provided with a four-wheel drive or six-wheel drive system.

According to a preferred variant of the invention, which can also make up an independent inventive concept, the contact means comprise movable contact means, such as wheels 34 or tracks, and stabilizers 32; control system 16 is further configured in such a way that:

if arm 18 is in a front angular field (for example A1) and stabilizers 32 are not active, the arm, when it moves, cannot go out of said front angular field; and if arm 18 is out of the front angular field, stabilizers 32 cannot be deactivated until arm 18 returns to said front angular field.

The front angular field contains the vertical plane including the longitudinal movement axis x-x and is symmetrical to said plane. The front angular field preferably coincides with central angular field A1.

When stabilizers 32 are active, they are capable of exchanging a force with the support surface so as to prevent the crane from rolling over. For example, stabilizers 32 are active when they are in an extracted position and rest on the support surface.

In this way, when stabilizers 32 are not active, arm 18 is prevented from rotating out of the front angular field, so as avoid generating an excessive lateral roll-over torque. On the contrary, when stabilizers 32 are active, arm 18 can rotate out of the front angular field, for example reaching lateral fields A2, A3, A4, A5. By so doing the safety during the use of the crane is increased.

Conveniently, in this variant, load sensors C1, C2, C3, C4 are only associated with stabilizers 32.

Furthermore, the invention provides a method to control a crane 10 for lifting and transporting loads, crane 10 comprising:

a base frame 12, for transferring the loads of crane 10 onto a support surface by means of a plurality of contact means in contact with said surface;

an arm 18 for lifting and transporting loads, which is capable of rotating relative to said base frame 12 around a vertical axis, wherein the angular range of said arm 18 around the vertical axis comprises a plurality of angular fields A1, A2, A3, A4, A5. The method comprises the following steps:

detecting the value of the force acting upon the respective contact means, detecting angular field A1, A2, A3, A4, A5 where said arm 18 is located, determining a danger condition based on the detected values, wherein said danger condition is determined according to different criteria in at least two different angular fields A1, A2, A3, A4, A5, carry out predetermined functions of crane 10, if said danger condition is reached.

Preferably, the danger condition is determined with a mathematical formula, whose variables include the detected values of the force acting upon said contact means, wherein two different formulas are used in at least two different angular fields A1, A2, A3, A4, A5.

Preferably, said formula takes into account the detected value of a different number contact means in at least two different angular fields A1, A2, A3, A4, A5.

Crane 10 and the control logics can be the ones described and discussed above, which, therefore, will not repeated hereinafter for the sake of brevity.

According to a preferred variant of the invention, which can also make up an independent inventive concept, the method comprises the following steps:

if arm 18 is in a front angular field (for example A1) and stabilizers 32 are not active, preventing the arm, when it moves, from going out of said front angular field; and if arm 18 is out of the front angular field, preventing stabilizers 32 from being deactivated until arm 18 returns to said front angular field.

Naturally, the principle of the invention being set forth, embodiments and implementation details can be widely changed relative to what described above and shown in the drawings as a mere way of non-limiting example, without in this way going beyond the scope of protection provided by the accompanying claims.

The invention claimed is:

1. A crane for lifting and transporting loads, comprising:

a base frame, for transferring loads of the crane onto a support surface by a plurality of contacts in contact with said surface;

an arm for lifting and transporting loads, which is capable of rotating relative to said base frame around a vertical axis, wherein an angular range of said arm around the vertical axis comprises a plurality of angular fields;

a control system, for:

obtaining, from load sensors, a value of force acting upon the respective contact, detecting the angular field where said arm is located;

determining a danger condition based on values detected by at least one of said load sensors, wherein said danger condition is determined according to different criteria in at least two different angular fields;

carrying out predetermined functions of the crane, if said danger condition is reached;

wherein said danger condition is determined with a mathematical formula, the mathematical formula having variables including the values detected by at least one of said load sensors, wherein said control system uses two different formulas in at least two different angular fields;

wherein each angular field of the formula is a sum of the values detected by at least some of the load sensors and a result of the formula is the value of a force or of a mass; if the value of the formula exceeds or reaches a threshold value, the danger condition is reached.

2. The crane according to claim 1, wherein said angular fields are arranged symmetrically relative to a vertical plane including a longitudinal movement axis of the crane.

3. The crane according to claim 2, wherein said angular fields comprise: a central angular field, wherein the vertical plane including the longitudinal movement axis passes through the central angular field; and a plurality of lateral angular fields.

4. The crane according to claim 3, comprising five angular fields, wherein a second and a fourth angular field are arranged left relative to the central angular field, and a third and a fifth angular field are arranged right relative to the central angular field; wherein the movable contacts include four wheels, or four stabilizers located at vertexes of a rectangle in plan view;

wherein:

when the arm is in the central angular field, the formula used is a sum of the values detected by a first load sensor and a second load sensor;

when the arm is in the second angular field, the formula used is a sum of the values detected by the first load sensor, the second load sensor and a fourth load sensor;

when the arm is in the third angular field, the formula used is a sum of the values detected by the first load sensor, the second load sensor and a third load sensor;

when the arm is in the fourth angular field, the formula used is a sum of the values detected by the second load sensor and the fourth load sensor;

when the arm is in the fifth angular field, the formula used is a sum of the values detected by the first load sensor and the third load sensor.

5. The crane according to claim 1, wherein said formula takes into account a different number of load sensors in at least two different angular fields.

6. The crane according to claim 1, wherein said contacts comprise movable contacts, comprising wheels or tracks, and stabilizers; said load sensors being associated with at least some of the movable contacts and with at least some of the stabilizers.

7. The crane according to claim 1, wherein each contact is associated with a respective load sensor.

8. The crane according to claim 1, wherein the contacts comprise movable contacts and stabilizers; the control system being further configured such that:

if the arm is in a front angular field and the stabilizers are not active, when the arm moves, the arm cannot go out of said front angular field; and if the arm is out of the front angular field, the stabilizers cannot be deactivated until the arm returns to said front angular field.

9. The crane according to claim 1, wherein the control system is configured to use a different formula for each angular field.

10. A method to control a crane for lifting and transporting loads, the crane comprising:

a base frame, for transferring loads of the crane onto a support surface by a plurality of contacts in contact with said surface;

an arm for lifting and transporting loads, which rotatable relative to said base frame around a vertical axis, wherein an angular range of said arm around the vertical axis comprises a plurality of angular fields;

the method comprises the following steps:

detecting a value of force acting upon the respective contact;

detecting the angular field where said arm is located;

determining a danger condition based on the detected values, wherein said danger condition is determined according to different criteria in at least two different angular fields;

carrying out predetermined functions of the crane, if said danger condition is reached;

wherein said danger condition is determined with a mathematical formula, the mathematical formula having variables including the detected values of the force acting upon said contacts, wherein two different formulas are used in at least two different angular fields;

wherein each angular field formula is a sum of the values detected by one or more load sensors, and a result of the formula is the value of a force or of a mass; if the value of the formula exceeds or reaches a threshold value, the danger condition is reached.

11. The method according to claim 10, wherein said formula takes into account the detected value of a different number of contacts in at least two different angular fields.

12. The method according to claim 10, further comprising the following steps:

if the arm is in a front angular field and the stabilizers are not active, when the arm moves, preventing the arm from going out of said front angular field; and if the arm is out of the front angular field, preventing stabilizers from being deactivated until the arm returns to said front angular field.

* * * * *